United States Patent [19]

Moller et al.

[11] 4,126,411

[45] Nov. 21, 1978

[54] ROUND COOLER FOR HOT BULK MATERIAL

[75] Inventors: Klaus Moller, Friedrichsdorf; Dierk Michel, Niddatal; Hartmut Wolert, Frankfurt am Main; Helmut Ernst, Offenbach, all of Fed. Rep. of Germany

[73] Assignee: Dravo Corporation, Pittsburgh, Pa.

[21] Appl. No.: 733,091

[22] Filed: Oct. 18, 1976

[30] Foreign Application Priority Data

Mar. 30, 1976 [DE] Fed. Rep. of Germany ..... 2613462

[51] Int. Cl.[2] ..... F27D 15/02

[52] U.S. Cl. ..... 432/80; 34/174

[58] Field of Search ..... 432/80; 34/168, 174; 214/17 R, 17 A, 17 C

[56] References Cited

U.S. PATENT DOCUMENTS

| | | | |
|---|---|---|---|
| 1,669,012 | 5/1928 | Nordstrom | 34/174 |
| 2,681,158 | 6/1954 | Henrikson | 214/17 R |
| 2,822,078 | 2/1958 | Haven | 214/17 R |
| 3,168,384 | 2/1965 | Greaves et al. | 34/168 |
| 3,331,595 | 7/1967 | Nelson et al. | 34/168 |

FOREIGN PATENT DOCUMENTS

| | | | |
|---|---|---|---|
| 640,773 | 1/1937 | Fed. Rep. of Germany | 34/174 |

*Primary Examiner*—John J. Camby

*Attorney, Agent, or Firm*—Parmelee, Miller, Welsh & Kratz

[57] ABSTRACT

The invention concerns a rotating round cooler for the cooling of hot loose material, especially hot iron ore sinter, consisting of a ring-form base plate, which is supported with treadrollers on a circular rail, a holding apparatus fastened to the base plate, a cooling chamber which is fastened movably to the holding device with inner and outer walls permeable to gas, whereby at least the bottom edge of the outer wall is located some distance from the base plate, a horizontal passage to the center of the cooler, a charging apparatus above the cooling chamber, a pick-off above the base plate and in the midst of the cooled material, a drive device for the rotary movement of the cooler, inlet devices for the gaseous cooling medium on the inside of the holding device, as well as blowers for the production of the pressure required for the cooling medium.

14 Claims, 8 Drawing Figures

ROUND COOLER FOR HOT BULK MATERIAL

BACKGROUND OF THE INVENTION

1. Field of the Invention

This invention relates to rotary coolers for cooling hot loose bulk material with cool air.

2. Prior Art

Hot, loose bulk material, particularly iron ore sinter, is cooled in rotary coolers by means of introduced cool air. The coolers have a cooling chamber which is bounded on the inside and the outside by walls permeable to gas. The cool air is introduced under pressure through the inner wall, blown through the loose material and exits through the outer wall. The cooling chamber can be formed either of circular individual cells arranged next to one another or between two ring walls arranged concentric to each other. The hot loose material is placed in the cooling chamber from above and removed by a pick-off as cooled material from the bottom plate of the cooler. With horizontal conduction of the cool air, the layer thickness of the material is limited by the pressure used, while the height of the material is a function only of the limit of the allowable wheel load. These coolers therefore require relatively little ground surface. Such coolers have been described in U.S. Pat. Nos. 3,168,384 and 2,681,158, and German patent publications AS 1,964,323, OS 2,005,928, AS 1,963,936, which use one or two circular cooling chambers. These coolers are run from a central bearing and require a supporting structure from the inside. Moreover, the cooling chambers are firmly integrated in the supporting structure, whereby thermal stresses are transferred to the support structure and cause slight deformities therein, and the support structure undergoes great wear from mechanical friction on the parts which come in contact with the material in motion.

Even on round coolers with bottom emptying of the cooling chamber, central operation is accomplished either by a center bearing or else there are two rails with flanges, which are subject to great wear and which place great loads, especially on the wheel bearings (German patent publications PS 1,025,916, AS 1,041,513, AS 1,145,196, AS 1,173,662).

For round coolers, in which the cooling air is blown in through a bottom permeable to gas — which, therefore, must be operated with a low material layer thickness — it is also known that the central operation of the cooler is done with horizontal contact rollers, which run on a horizontal circular track. These coolers have bottom and side emptying, and must be braced on two concentric rails with tread rollers, and the gas-permeable bottom is an integral part of the support construction.

From German patent publication PS 1,133,557 for round coolers with bottom emptying and from German patent publication OS 1,926,753 for round coolers with pick off emptying of the material from a bottom plate it is shown that the cooling chamber is formed by cells located next to each other, so that the cells are movably fastened to the supporting construction. Thus no heat stresses are transferred to the support construction, these types undergo no wear from the material to be cooled. The support apparatus, however, overstresses the inner room of the cooler.

A round cooler is shown by German patent publication OS 1,944,669, on which the outer wall of the cooling chamber moves freely on the bottom plate and thus transfers no heat stresses to the support construction. The central operation is done with a central bearing and the support apparatus overstresses the inner space of the cooler.

The purpose of the invention is to eliminate the disadvantages of the round coolers demonstrated with emptying by picking off the material from the bottom plate and especially to manage to have the inner space free of the support construction, to protect the support construction from heat stresses and abrasive wear from the material to be cooled, and to keep the construction of the cooler simultaneously as light and as static as possible.

SUMMARY OF THE INVENTION

The invention solves the above problems by providing a round cooler in which the base plate is formed as a rigid disc, in which the walls of the supporting apparatus form a reinforced cylinder which supports the cooling chamber and in which the cylinder is reinforced in the radial direction by corner frames on the disc and is reinforced on the inside in the upper part with an encircling ring support. For horizontal positioning and centrifuging of the coolers, horizontal flangeless contact rollers which run on a horizontal circular flangeless track are located on the inside of the disc while the vertical forces of the coolers are transferred to a running track by contact rollers which are located slightly below the center of mass of the moving system.

The term "cylinder" means both a circular cylinder and also a polygonal cylinder, which is open on the top and bottom. The terms "inside" and "outside" are always in relation to the midpoint of the cooler.

A significant improvement consists of the fact that the rigid disc is made of radial and horizontal sections, which are bound together on the ends by horizontally tangential shapes, and the areas formed by the shapes are reinforced by braces, and the areas covered with plates on top. The plates can be placed on top loosely and held in place by limiters, or they can be fastened down. This configuration gives effective reinforcement with little weight.

A significant improvement lies in the fact that the cylinder consists of vertically standing beams, and every second panel enclosed by the beams is reinforced with lattice braces. It is also possible to reinforce each panel with lattice braces but in practice this is not necessary. This configuration gives effective reinforcement with little weight.

A significant improvement lies in the fact that the corner frames are on the outside of the cylinder. Thus the corner frames are in the dead space and take up no room. They can, however, be also located on the inside.

A significant improvement lies in the fact that the encircling ring support is formed as a double-T-support, the leg of which lies horizontal and has a height of at least 600 mm. Thus a good reinforcing effect is achieved with little weight.

A significant improvement lies in the fact that the walls of the cooling chamber are formed of individual cells next to one another and the individual cells in the lower part of the cylinder are in a fixed position and the upper parts in a loose holder. Thus no thermal stresses are conducted to the support apparatus and the supporting apparatus is not subjected to wear.

A significant improvement in an alternate form of the invention lies in the fact that the lower part of the cylinder is formed as a cantilever, and the inside and outside walls of the cooling chamber are formed as ring-shaped walls arranged on the cantilever so as to be radially movable but with the extent of radial movement limited by blocking. The ring-form walls are generally formed polygonally for technical manufacturing reasons. They can also be shaped round. Thus no thermal stresses are conducted to the support apparatus and there is no wear of the support apparatus.

A significant improvement in the alternate form of the invention lies in the fact that the outer wall, on its outer side, at least in the upper part, is reinforced with a transverse girder, and the inner wall, at least in its upper part, is separated from the cylinder by distance pieces. The encircling transverse girder for the reinforcement of the outer wall can also be located in the outer wall itself. This would absorb in a simple way the wall pressure caused by the material.

A significant improvement lies in the fact that a circular air channel is located on the inside of the cylinder, with blowers in the inside of the cooler with connections to the air channel. Thus the inner space of the cooler can be used for the installation of the blowers. The cooling air can also be sucked in from suction ports from outside the cooler, in order to prevent the suction of heated cooling air.

A significant improvement lies in the fact that the cylinder is equipped with a feed chamber for the cooling medium via a stationary covering and is provided with leads from the blowers. The connections from the blowers can approach either from above through the stationary cover or below into the feed chamber. This configuration is principally used if the inner chamber is too small for the installation of the blowers or the inner chamber cannot be used for some reason.

A significant improvement lies in the fact that the air channel or feed chamber for the cooling medium in areas of closing or charging is closed against the inner wall of the cylinder pressing against it by a stationary shield and packing, so that the stationary shield is removed from the loading and unloading area by at least the distance of two vertical beams. Thus the entry of cooling air is, in a simple way, eliminated from the loading and unloading area. If cooling air were to penetrate into these areas, the result would be a significantly higher dust production.

A significant improvement lies in the fact that on the outer wall of the cooling chamber at the lowest exit location of the cooling medium is located a rotary air conduit of sheet iron cover which is larger toward the top. The enlargement at the top is done so that it does not influence the gas rate. Thus the warmed cooling air which comes out in the lower area of the cooling chamber is diverted to the top and possible carried over fine grain is returned.

A significant improvement lies in the fact that the loading and unloading areas are located above each other. Thus the usable cooling surface is increased, and only one diaphragm setting for the cooling air intake and one dust removal location are necessary.

A significant improvement lies in the fact that the inner and outer walls of the cooling chamber are made impervious to gas in the upper and lower parts, over a length which is greater than the layer thickness of the material in the cooling chamber. Thus a discharge of warmed cooling air from the cooling chamber upward and downward is practically eliminated.

BRIEF DESCRIPTION OF THE DRAWINGS

The invention is explained by means of the illustrations in which.

DESCRIPTION OF THE PREFERRED EMBODIMENT

Figure 1:
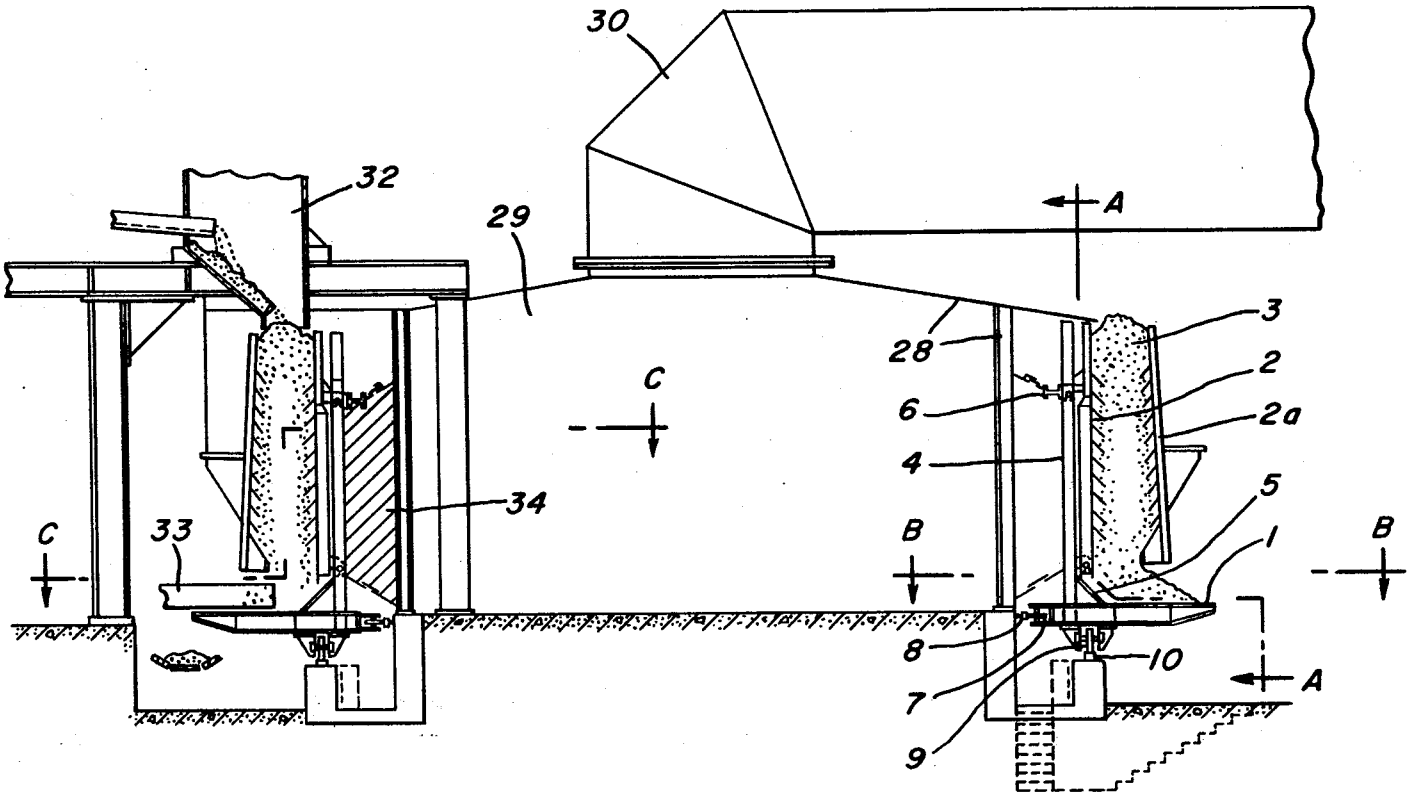
FIG. 1 is a vertical cross-section of a cooler according to the invention.

Referring to FIG. 1, a rigid disc 1 gives the cooler its radial reinforcement. The walls 2, **2*a* of the cooling chamber 3 are suspended loosely in the support apparatus which includes a reinforced cylinder 4. The reinforced cylinder 4 is held fast to the rigid disc by corner frames 5 and on the inside by a rotary transverse girder 6. For horizontal operation of the cooler, the flangeless contact rollers 7 are used, which run on the circular track 8. The flangeless rollers 9 transfer all the vertical loads to the circular track 10, which is firmly anchored in the concrete foundation. The cooler is loaded with the loading flanges 32 and emptied with the aid of the skimmer 33. The cylinder 4 is covered with the stationary covering 28 and thus forms the feed chamber 29 for the cooling medium, which is fed through the tubing 30 from jets (not shown). In the loading area 32 and unloading area 33 of the cooler, the cooling medium is cut off by the shield 34**.

Figure 2:
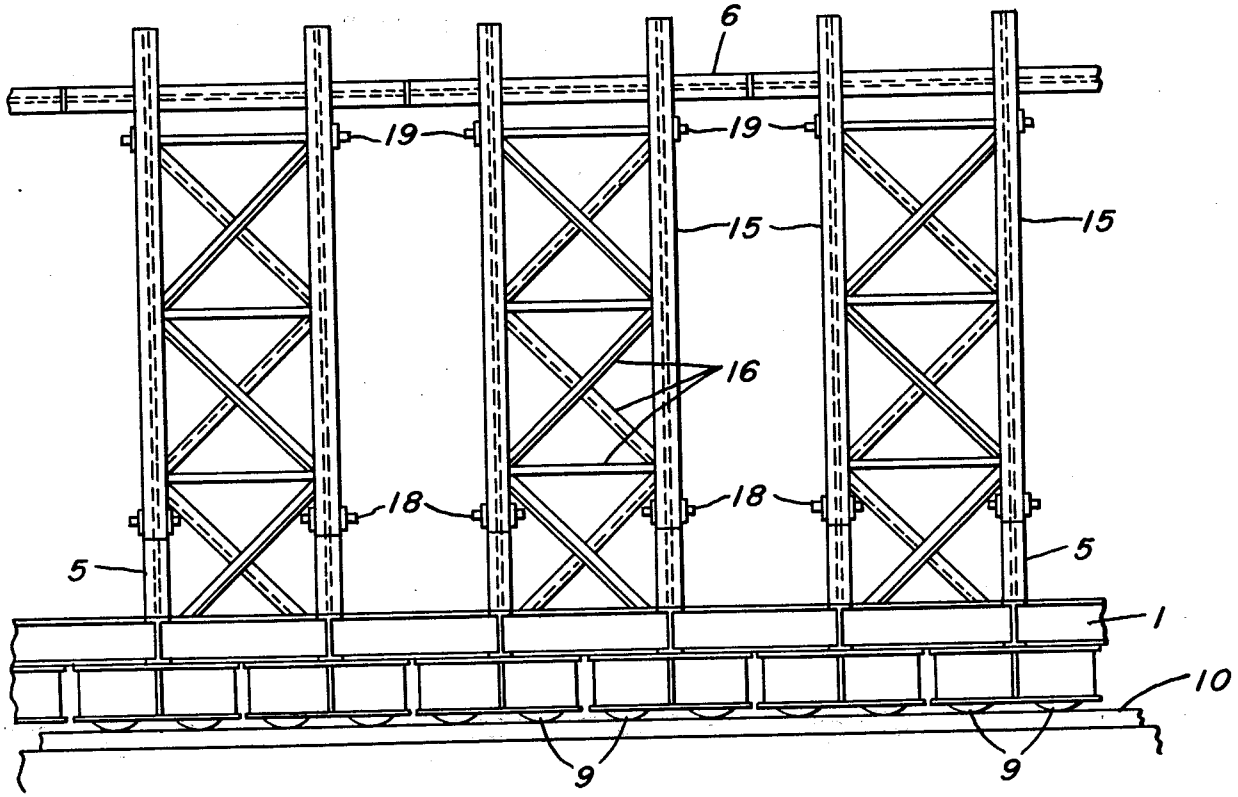
FIG. 2 is a developed projection of the view A—A of FIG. 1.

FIG. 2 shows the cylinder 4 in the view A—A from FIG. 1 without the cooling chamber 3. The cylinder 4 consists of vertically standing beams 15, which are reinforced in every second span with braces 16. The number of areas with braces is variable. The rotary transverse girder 6 bonds the free lengths of the beams 15 into a cylinder 4, which is connected to the rigid disc firmly by corner frames 5, which transfer their vertical load to the rollers 9, which run on the circular track 10. In each reinforced area, a cell of the cooling chamber can be suspended in the firm bearing 18 or the loose bearing 19.

Figure 3:
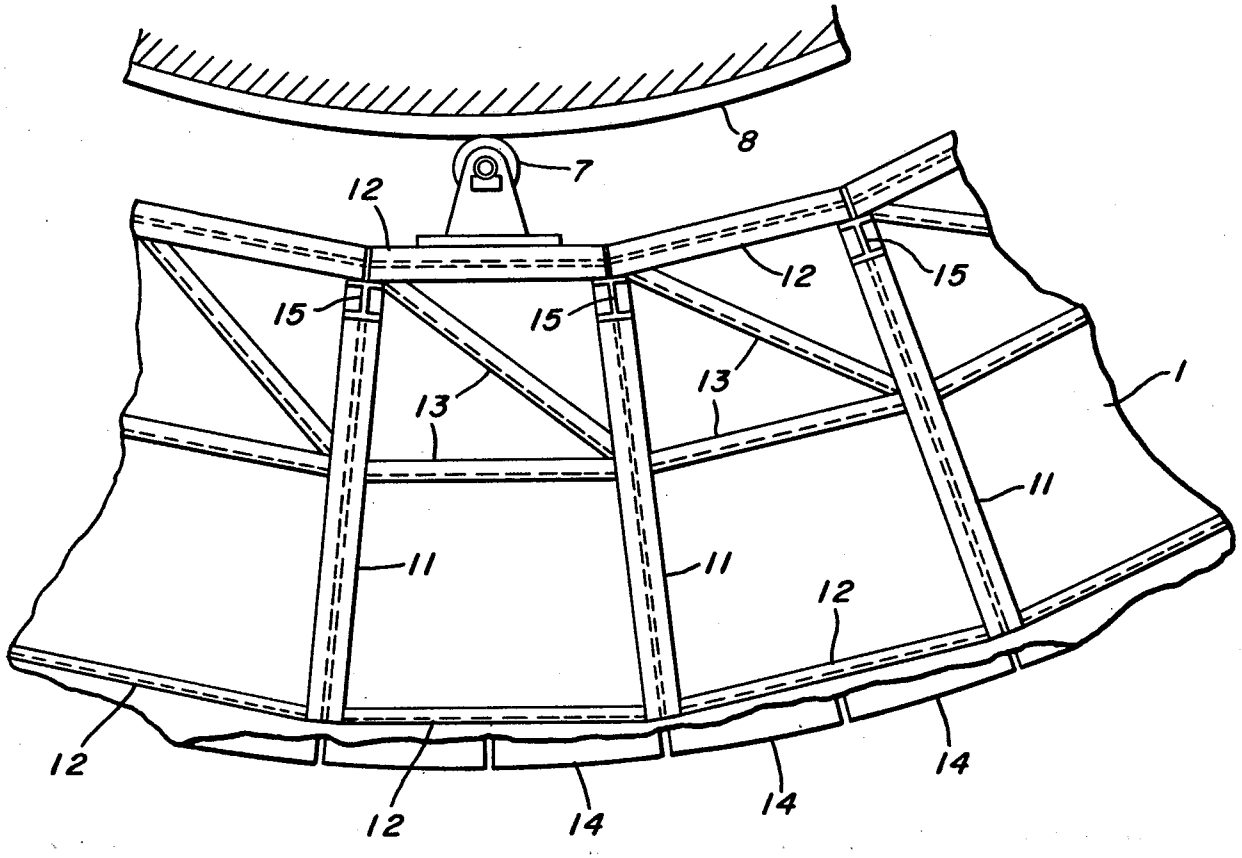
FIG. 3 is a horizontal section taken along the line B—B of FIG. 1.

FIG. 3 is a top view of the rigid disc 1. The rollers 7, which travel on the track 8, are connected firmly to the rigid disc 1 and carry it horizontally around the cooler center-point. The rigid disc 1 consists of radial and horizontally arranged shapes 11, which are connected firmly to each other at the ends, by tangential horizontal shapes 12 so that they form a polygonal circular plate.

The areas which arise are reinforced either with braces 13 or with plate girders. The applied plates 14 form a surface on which the cooling material can be supported.

Figure 4:
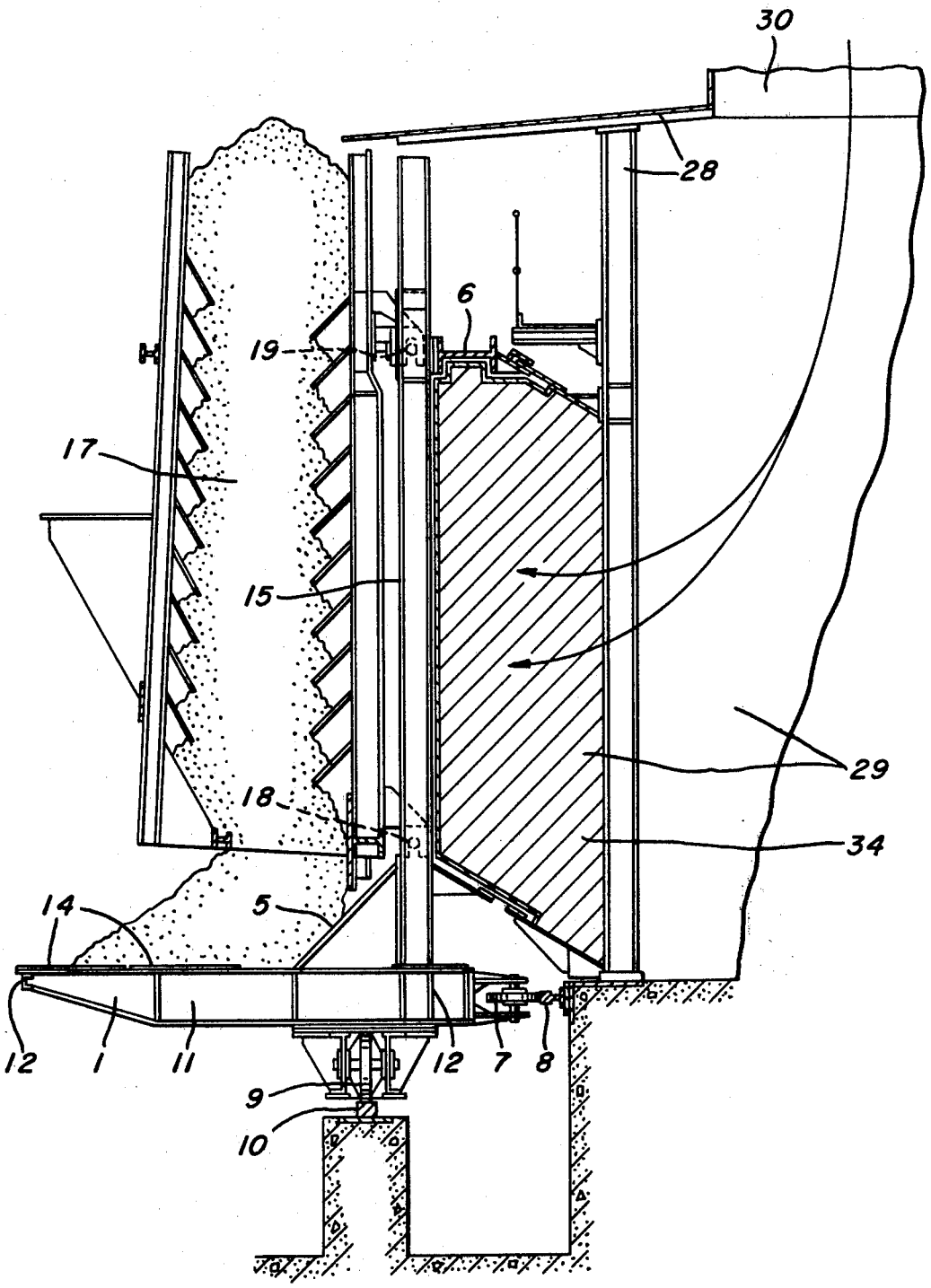
FIG. 4 is a vertical section through one half of a cooler with cooling cells and with schematic representation of the air passage from above into the cooling chamber.

Turning to FIG. 4, the vertical beams 15 of cylinder 4 stand on the rigid disc 1, reinforced with corner frames 5. The encircling transverse girder 6 binds the upper free ends of the beams 15 with each other into a reinforced ring. The cell 17 is suspended in the cylinder 4 in the lower fixed bearing 18 and in the upper loose bearing 19. The material to be cooled rests on the plates 14, which are arranged so that they can expand freely. The contact rollers 7 are arranged horizontally and transfer the rotational forces to the circular rotation track 8. The tread rollers 9 transfer the vertical loads to the circular track 10. The cooling air comes from blowers with the aid of the air feed 30 in the air feed chamber 29. The shields 34, which cut off the cooling medium in the loading and unloading areas, are here portrayed fastened to the stationary supports of the cover 28. When the air feed chamber 29 is used, the cooling medium can be fed in both from above and below.

Figure 5:
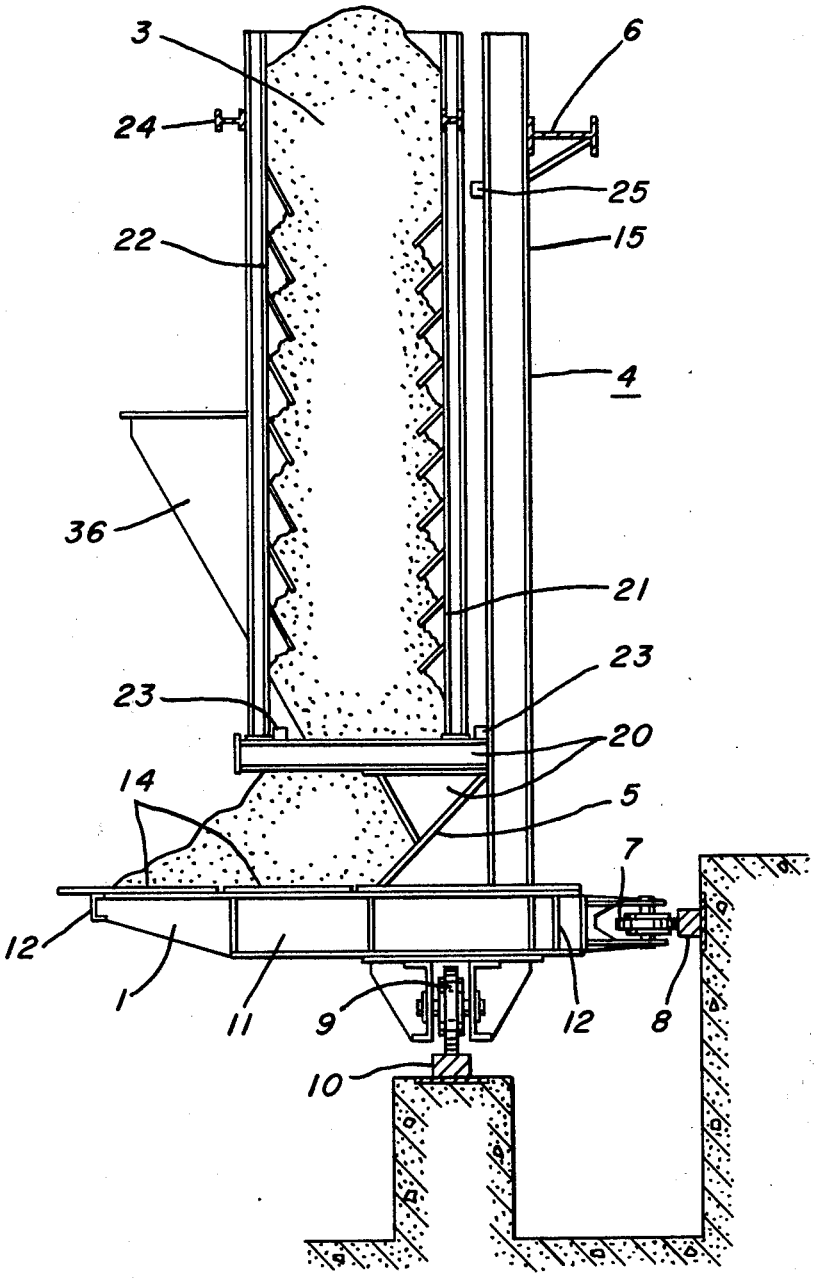
FIG. 5 is a vertical section through one half of a cooler with one cooling chamber with continuous circular walls, the air intake is not represented.

FIG. 5 illustrates an alternate form of the invention in which a single annular cooling chamber 3 is formed by concentric inner and outer walls 21 and 22. The inner and outer walls, 21 and 22, repectively, rest on cantilevered support brackets 20 distributed around the circumference of the cylinder 4. On the cantilevered support brackets 20 are found distance cams 23 both for the inner and the outer wall, which have the task of guaranteeing the roundness, but which leave the walls expandable upon heating. The same task is served by the upper distance cams 25, which are fastened to the supporting construction. The rotary transverse girder 24 on the outer wall absorbs the vessel pressure from within. The air duct 36 should conduct the warmed cooling medium toward the top over the whole circumference and possibly feed the carried off fine grain back to the cooling chamber.

Figure 6:
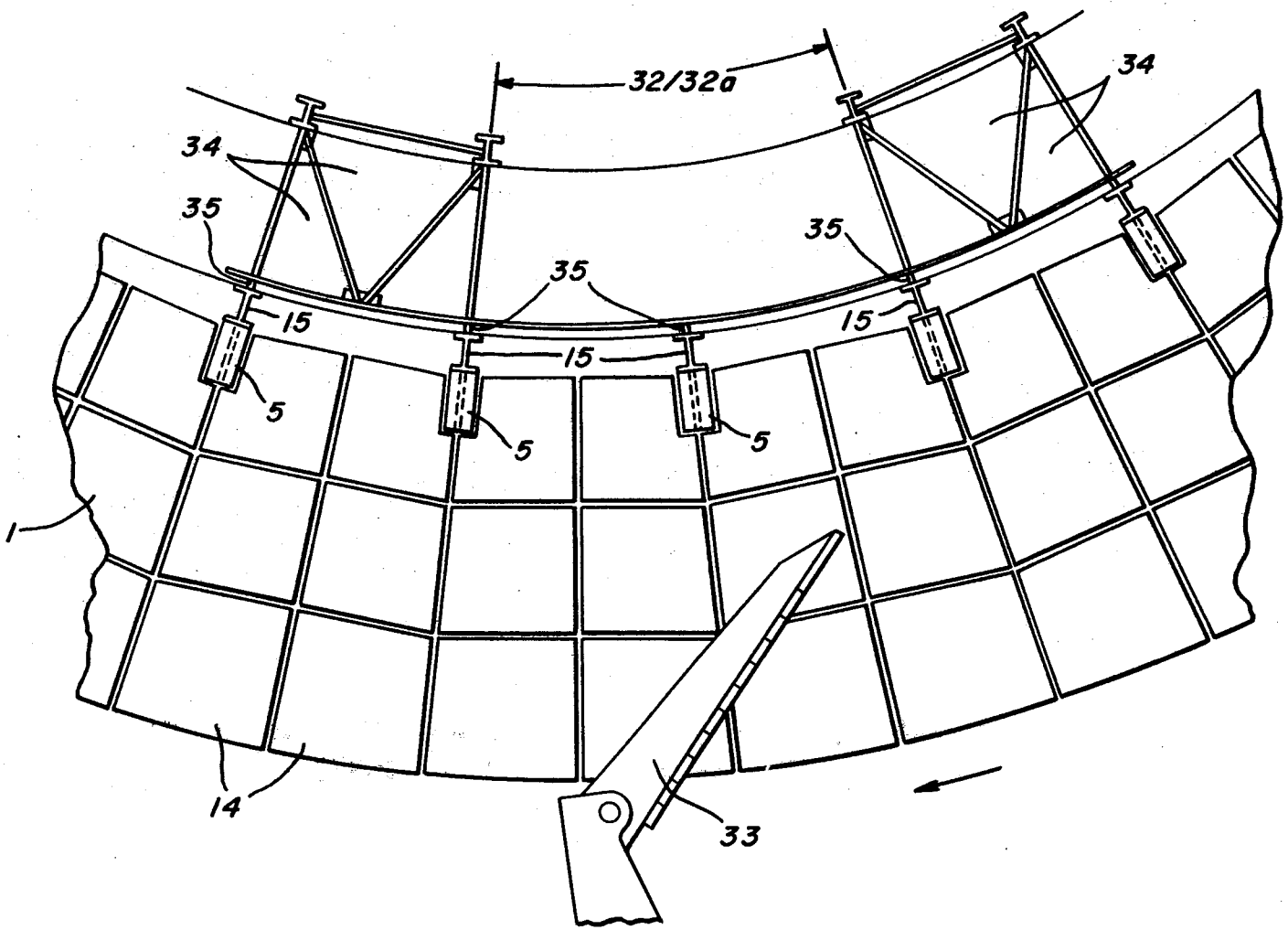
FIG. 6 is a horizontal section taken along the line C—C of FIG. 1, representing the loading and unloading areas.

As shown in FIG. 6, in the loading zone 32 and unloading zone 33, the cooling medium is cut off by the stationary shield 34 and the packing 35, which is fastened to the vertical beams 15. The rigid disc 1 with the vertical beams 15 reinforced by the corner frames 5 and with the plates 14, turns around the cooler midpoint relative to the stationary screen 34 and the discharge device 33.

Figure 7:
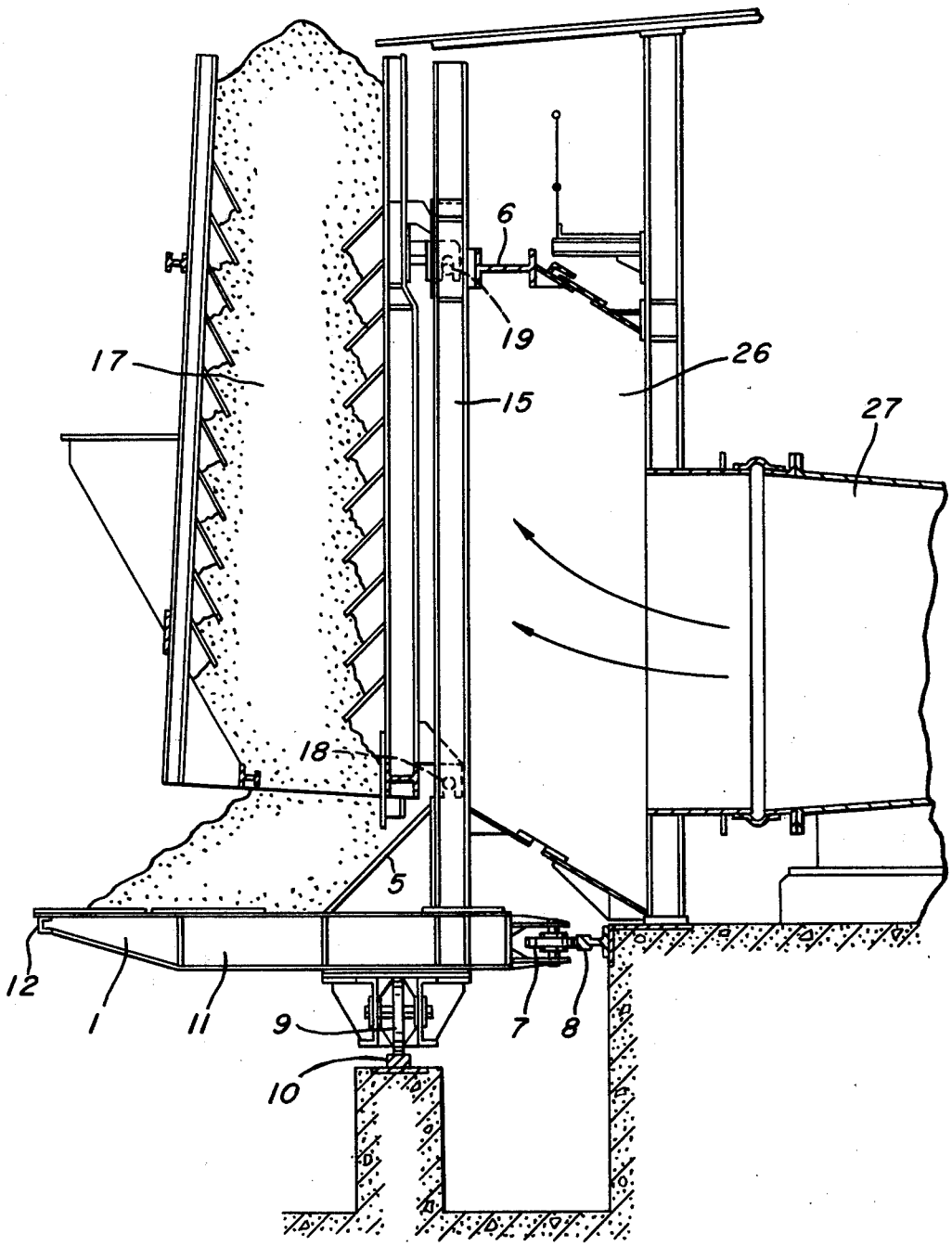
FIG. 7 is a vertical section through one-half of a cooler with cooling cells and with schematic representation of the air passage in a circular air channel with blowers located in the inner space of the cooler.

As illustrated in FIG. 7, the arrangement of blowers in the inner space allows the air feed chamber 26 to be formed in a circle. The blowers 27 are connected to the air feed chamber 26 by means of a transition piece. The cool air can either be absorbed directly into the inner space or through absorption ducts from outside.

Figure 8:
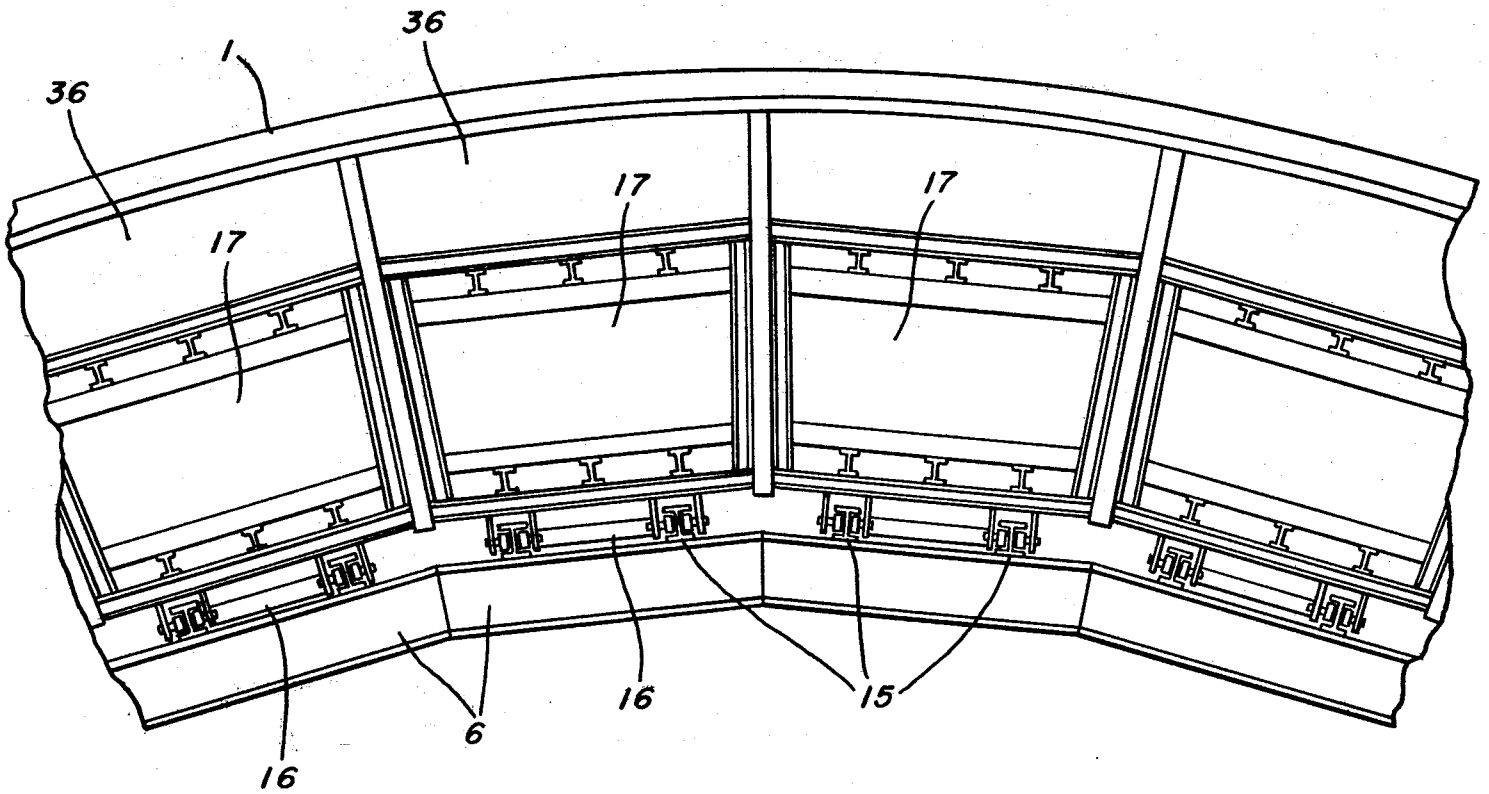
FIG. 8 is a partial top view of a cooler with cooling cells and with schematic representation of the air passage in a circular air channel with blowers located in the inner space of the cooler.

FIG. 8, which is a partial top view of the cooler, shows the rigid disc 1 and the vertically standing beams 15, which are reinforced in every second span by braces 16. The free top ends of the beams 15 are bound with the transverse girder 6. The cells 17 are loose in the overhead suspensions of the beams 15. The air ducts 36 are located along the entire circumference.

The advantages of the invention are principally that the cooler enables a definite static construction with easy operation, that the inner space is kept free and the support construction is threatened neither mechanically nor thermally.

We claim as our invention:

1. Rotary round cooler for the cooling of hot bulk material, especially hot iron ore sinter, consisting of an annular circular base plate, which is supported with contact rollers on a circular track for rotation in a horizontal plane, a support frame attached to the base plate, a movably fastened circular cooling chamber on the support frame with gas permeable inner and outer walls, and with at least the bottom edge of the outer wall located at some distance from the base plate, a loading device above the cooling chamber, a pick-off unloading device located above the base plate and in the midst of the cooled material, a drive device for the rotary motion of the cooler, a feed device located on the inside of the support frame for the gaseous cooling medium, as well as blowers for the production of the required pressure for the cooling medium, said combination wherein: the base plate is formed as a rigid disc (1), the walls (2, 2a) of the cooling chamber (3) are supported on a support frame including a reinforced cylinder (4) reinforced in the radial direction by corner frames (5) on the disc (1) and reinforced in the upper part on the inside by a rotary transverse girder (6), and, for the horizontal rotation of the cooler, horizontal, flangeless contact rollers (7) are located on the inside of the disc (1), which run on a horizontal, circular, flangeless track (8) for rotation, and the vertical forces of the cooler are transferred to the track (10) by the flangeless contact rollers (9) located slightly below the center of gravity of the moving system.

2. A round cooler according to claim 1 wherein the rigid disc (1) consists of radial and horizontally arranged shapes (11), which are bound together at the ends by horizontal tangential shapes (12), and the areas formed by the shapes are reinforced with braces (13) and the areas covered over with superimposed plates (14).

3. A round cooler according to claim 1 wherein the cylinder (4) consists of vertically standing beams (15), and the area bordered by every second beam (15) is reinforced with lattice braces (16).

4. A round cooler according to claim 1 wherein the corner frames (5) are located on the outside of the cylinder (4).

5. A round cooler according to claim 1 wherein the rotary transverse girder (6) is formed as a double-T girder, the leg of which lies horizontal and has a height of at least 600 mm.

6. A round cooler according to claim 1 wherein the walls (2, 2a) of the cooling chamber (3) are formed by individual cells (17) located next to each other, and the individual cells (17) are suspended in the bottom part of the cylinder (4) in a firm bearing (18) and in a loose bearing (19) in the upper part.

7. A round cooler according to claim 1 wherein the lower part of the cylinder (4) is formed as a bracket (20), and the inner (21) and outer (22) walls of the cooling chamber (3) are formed as circular continuous walls and radially adjustable on the bracket (20), and the adjustment possibilities are limited by blocks (23).

8. A round cooler according to claim 7 wherein the outer wall (22) on its outer side, at least in the upper part, is reinforced with a rotary transverse girder (24) and the inner wall (21), at least in the upper part, is held against the cylinder (4) by distance pieces (25).

9. A round cooler according to claim 1 wherein an annular air duct (26) is located on the inside of the cylinder (4) and blowers are located in the inside of the cooler and are connected to the air duct (26) with connecting pipes.

10. A round cooler according to claim 1 wherein the cylinder (4) is provided with a stationary cover (28), to form a feed chamber (29) for the cooling medium and is provided with feeders (30) from the blowers.

11. A round cooler according to claim 10 wherein the feed chamber (29) for the cooling medium is cut off by a stationary screen (34) and packing (35) for the cooling medium in the vicinity of the loading device (32) and unloading device (33) against the inner wall of the cylinder (4), and the stationary screen (34) is extended in front of and behind the loading and unloading area by the separation of two vertical beams (15) of the cylinder (4).

12. A round cooler according to claim 1 wherein a sheet metal covering opening toward the top (36) is located as an air conductor on the outer wall (2a) of the cooling chamber (3) at the lowest exit point of the cooling medium.

13. A round cooler according to claim 1 wherein the loading (32) and unloading (33) devices are arranged one above the other.

14. A round cooler according to claim 1 wherein the inside (2) and outside (2a) wall of the cooling chamber in the upper and lower part are made impermeable to gas for a length which is greater than the layer thickness of the material in the cooling chamber (3).

* * * * *